US008534316B2

(12) United States Patent
Nederegger et al.

(10) Patent No.: US 8,534,316 B2
(45) Date of Patent: Sep. 17, 2013

(54) ELEVATED FIRST FILL VALVE IN SUCTION DIESEL UNITS AND PUMP MODULES

(75) Inventors: Matthias Nederegger, Rochester Hills, MI (US); Thomas Sippel, Fulda (DE); Sabine Reichelt, Rodgau (DE)

(73) Assignee: Continental Automotive Systems, Inc., Auburn Hills, MI (US)

( * ) Notice: Subject to any disclaimer, the term of this patent is extended or adjusted under 35 U.S.C. 154(b) by 1476 days.

(21) Appl. No.: 11/605,228

(22) Filed: Nov. 29, 2006

(65) Prior Publication Data

US 2007/0125431 A1 Jun. 7, 2007

Related U.S. Application Data

(60) Provisional application No. 60/742,443, filed on Dec. 5, 2005.

(51) Int. Cl.
*E03B 11/00* (2006.01)

(52) U.S. Cl.
USPC ..... 137/574; 137/576; 141/59; 123/511; 123/514; 123/509; 123/381

(58) Field of Classification Search
USPC ..... 123/511, 514, 509, 381; 137/574, 137/576; 141/59
See application file for complete search history.

(56) References Cited

U.S. PATENT DOCUMENTS

| | | | | |
|---|---|---|---|---|
| 5,396,872 | A * | 3/1995 | Ruger et al. | 123/514 |
| 5,647,330 | A * | 7/1997 | Sawert et al. | 123/509 |
| 2005/0011558 | A1 * | 1/2005 | Schmitt | 137/565.17 |
| 2005/0087178 | A1 | 4/2005 | Milton | |
| 2005/0103805 | A1 * | 5/2005 | Briggs et al. | 222/181.1 |

FOREIGN PATENT DOCUMENTS

| | | | |
|---|---|---|---|
| DE | 10303390 | | 8/2004 |
| DE | 10303390 | A1 * | 8/2004 |
| EP | 1531257 | | 5/2005 |

* cited by examiner

*Primary Examiner* — John K Fristoe, Jr.
*Assistant Examiner* — Marina Tietjen

(57) ABSTRACT

A reservoir structure of a fuel suction unit or pump module for a diesel vehicle is provided. The reservoir structure includes a reservoir 10 having a bottom surface 14. A primary opening 12 is provided in the bottom surface for permitting fuel to pass from a fuel tank of the vehicle into the reservoir. A secondary opening 16 is provided in the reservoir 10 that is elevated from the bottom surface 14. A valve member 18 is associated with the secondary opening 16. The valve member 18 is constructed and arranged to close the secondary opening under certain pressure conditions in the reservoir and, under pressure conditions in the reservoir different from the certain pressure conditions, to permit fuel to enter the reservoir through the secondary opening in the event the primary opening is substantially blocked.

8 Claims, 3 Drawing Sheets

ELEVATED FIRST FILL VALVE IN SUCTION DIESEL UNITS AND PUMP MODULES

This application claims the benefit of the earlier filing date of U.S. Provisional Application No. 60/742,443, filed on Dec. 5, 2005, which is incorporated by reference herein in its entirety.

FIELD OF THE INVENTION

The invention relates fuel supply units for diesel fueled vehicles and, more particularly, to a valve structure in reservoir of a suction diesel unit that is elevated from a bottom surface of the reservoir.

BACKGROUND OF THE INVENTION

Diesel fuel has the tendency to collect water which potentially will sink to the bottom of a fuel reservoir of a vehicle and freeze or create a waxing layer under cold conditions. Such freezing or the creation of a waxing layer may block a primary fill valve in the bottom of the reservoir and thus prevent a diesel suction unit from operating with the result being that the vehicle will not prime with fuel.

Accordingly, there is a need provide a fill valve elevated from a reservoir bottom to ensure priming of a vehicle during cold operating conditions.

SUMMARY OF THE INVENTION

An object of the present invention is to fulfill the need referred to above. In accordance with the principles of the present invention, this objective is obtained by providing a reservoir structure of a fuel delivery structure for a diesel vehicle. The reservoir structure includes a fuel reservoir having a bottom surface. A primary fill opening is provided in the bottom surface for permitting fuel to pass from a fuel tank of the vehicle into the reservoir. A secondary fill opening is provided in the reservoir and is elevated from the bottom surface. A first valve member is associated with the primary fill opening to close the primary fill opening under certain pressure conditions in the reservoir and, under pressure conditions in the reservoir different from the certain pressure conditions, to permit fuel to enter the reservoir through the primary fill opening. A second valve member is associated with the secondary fill opening to close the secondary fill opening under certain pressure conditions in the reservoir and, under pressure conditions in the reservoir different from the certain pressure conditions, to permit fuel to enter the reservoir through the secondary fill opening in the event the primary opening is substantially blocked.

Other objects, features and characteristics of the present invention, as well as the methods of operation and the functions of the related elements of the structure, the combination of parts and economics of manufacture will become more apparent upon consideration of the following detailed description and appended claims with reference to the accompanying drawings, all of which form a part of this specification.

BRIEF DESCRIPTION OF THE DRAWINGS

The invention will be better understood from the following detailed description of the preferred embodiments thereof, taken in conjunction with the accompanying drawings, wherein like reference numerals refer to like parts, in which.

DETAILED DESCRIPTION OF THE EXEMPLARY EMBODIMENTS

Figure 1A:
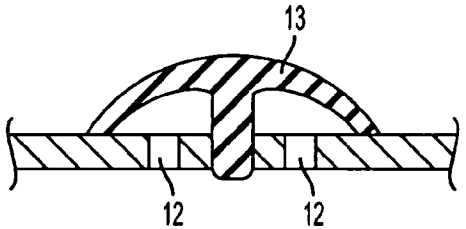
FIG. 1*a* is a sectional view showing a valve associated with the primary fill opening in the reservoir of FIG. 1.
Figure 1:
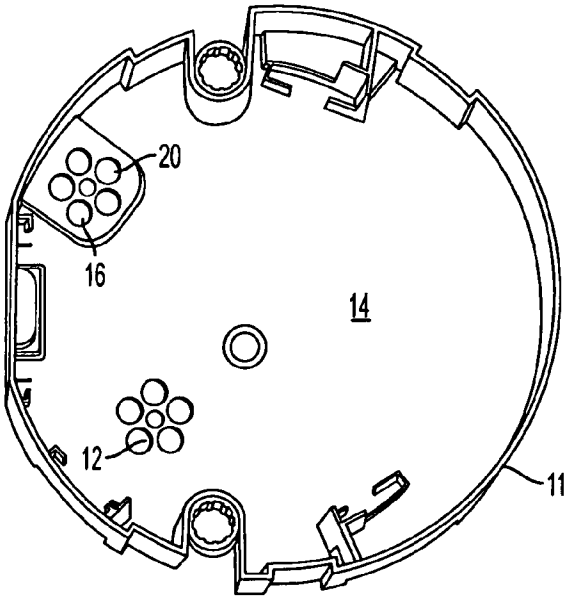
FIG. 1 is a top view of a bottom of a fuel reservoir of a diesel suction unit including a primary fill opening and an elevated fill opening in accordance with the principles of an embodiment of the present invention.
Figure 4:
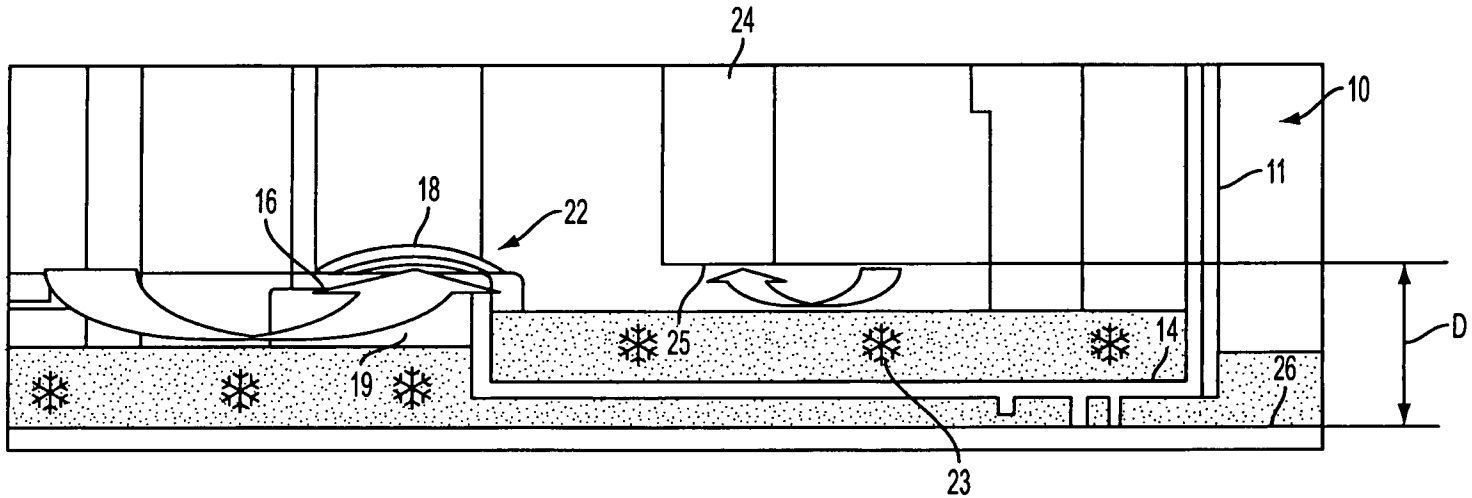
FIG. 4 shows the elevated fill valve structure of FIG. 3 in relation to a suction tube for priming an engine.

With reference to FIGS. 1 and 4 a reservoir structure, generally indicated at 10, includes a reservoir 11 having a primary fill opening 12 in a bottom surface 14 thereof. It is noted that FIG. 1 shows only a bottom portion of the reservoir 11. A conventional elastomer umbrella-type valve member 13 (FIG. 1*a*) is associated with the primary fill opening 12 that permits fuel to be drawn into the reservoir 11 via suction created by a suction unit having a suction tube 24 (FIG. 4) in the conventional manner. As noted above, since the primary opening 12 is on the bottom 14 of the reservoir, ice may form to block the opening 12 and prevent fuel from entering the reservoir 11 and thus prevent priming of a vehicle engine.

Figure 3:
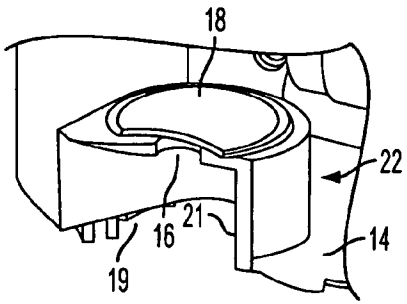
FIG. 3 is a side view of a portion of the reservoir of FIG. 1 showing a valve member associated with the elevated fill opening to define an elevated fill valve structure.
Figure 2:
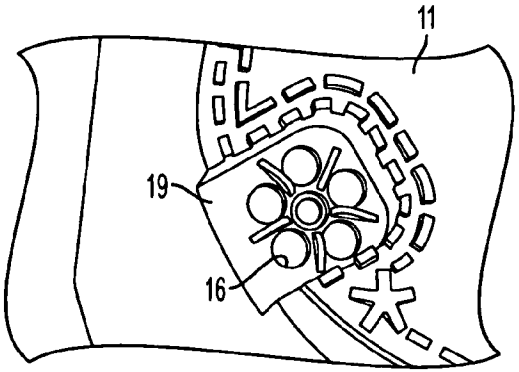
FIG. 2 is an enlarged bottom view of the elevated fill opening of FIG. 1.

In accordance with the principles of the invention and as best shown in FIGS. 1-3, a secondary opening (or openings) 16 is provided in the reservoir 10 that is elevated from the bottom surface 14. As shown in FIG. 3, a conventional elastomer umbrella-type valve member 18 is coupled to the reservoir via opening 20 and is thus associated with the opening(s) 16. Thus, the opening 16 and associated valve member 18 define an elevated fill valve structure 22. The valve members 13 and 18 can be of any configuration that is constructed and arranged to close the associated opening under certain pressure conditions in the reservoir 10 and under different pressure conditions in the reservoir, to move or deform to permit fuel to enter the reservoir 11.

As shown in FIG. 4, the fill valve structure 22 ensures that a suction unit (only tube 24 shown) still will operate and a vehicle will prime since the opening 16 of the fill valve structure 22 is elevated with respect to bottom surface 14 of the reservoir 11 and thus above ice 23. Thus, the opening 16 is either higher, on the same level as, or lower than the suction tube 24 of the suction unit inside the reservoir 11. The exact location of the opening 16 depends on tank geometry. In the illustrated embodiment, the opening 16 is at the same height D as the bottom opening 25 of the suction tube 24 with reference to a bottom surface 26 of a fuel tank.

As best shown in FIGS. 2 and 3, the fill valve structure 22 defines a fuel pocket 19 between the bottom 14 of the reservoir and the bottom 26 of the fuel tank. The pocket 19 is defined by a step 21 in the bottom 14. The openings 16 communicate with the pocket 19 and thus the fill valve structure will still function when the primary valve 13 associated with openings 12 in the reservoir bottom 14 are iced or waxed up.

Figure 5:
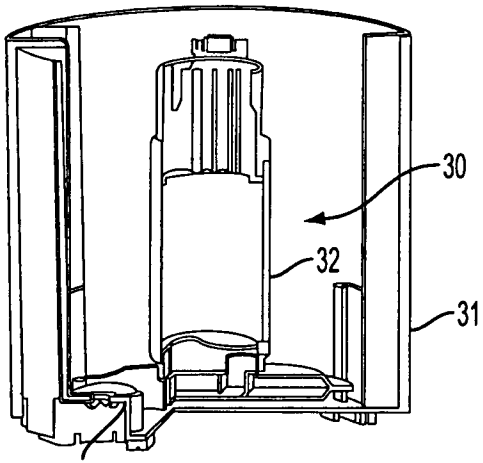
FIG. 5 is a view of another embodiment of an elevated fill valve structure employed in a pump module, shown partially cut-away.
Figure 6:
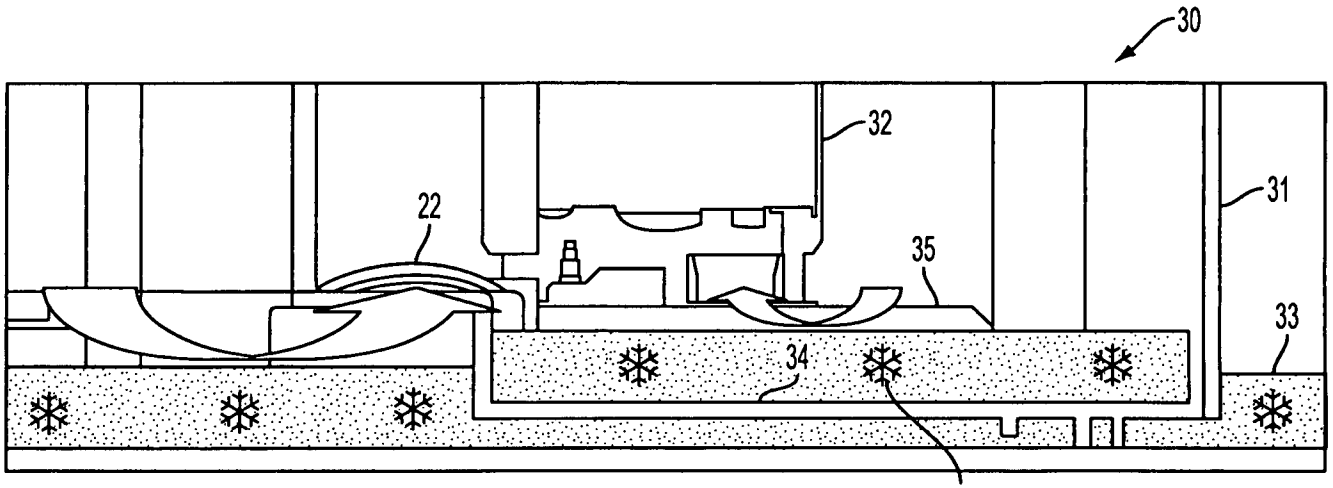
FIG. 6 is an enlarged view of the fill valve structure of the pump module of FIG. 5.

Although the fill valve structure 22 is described for use in diesel suction units, the fill valve structure 22 can be employed in conventional diesel fuel pump modules. Thus, as shown in FIGS. 5 and 6, the elevated fill valve structure 22 is provided in a reservoir 31 of a pump module, generally indicated at 30. The module 30 has a fuel pump 32 that draws fuel from a fuel tank 33 into the reservoir 31. A filter 35 is associated with the fuel pump 32. The fill valve structure 22 is elevated from the bottom 34 the swirl pot, and will still function and let diesel fuel pass into the reservoir 31 when the primary valve (not shown) in the reservoir bottom is iced up or waxed up. The elevated fill valve structure 22 needs to be positioned slightly below the pump inlet filter top surface to allow the diesel fuel to get into the pump inlet.

The elevated fill valve structure 22 has been described for use in diesel fuel applications, but can be employed in reservoirs using any fuels wherein icing may be an issue.

The foregoing preferred embodiments have been shown and described for the purposes of illustrating the structural and functional principles of the present invention, as well as illustrating the methods of employing the preferred embodiments and are subject to change without departing from such principles. Therefore, this invention includes all modifications encompassed within the spirit of the following claims.

What is claimed is:

1. A reservoir structure of a fuel delivery structure for a diesel vehicle, the reservoir structure including:

a fuel reservoir having a bottom surface, a primary fill opening in the bottom surface for permitting fuel to pass from a fuel tank of the vehicle into the reservoir, a secondary fill opening in the reservoir that is elevated from the bottom surface, the secondary fill opening communicating the fuel tank with the reservoir for permitting fuel to pass from the fuel tank directly into the reservoir, a first valve member associated with the primary fill opening constructed and arranged to close the primary fill opening under certain pressure conditions in the reservoir and, under pressure conditions in the reservoir different from the certain pressure conditions, to permit fuel to enter the reservoir through the primary fill opening, and a second valve member associated with the secondary fill opening constructed and arranged to close the secondary fill opening under certain pressure conditions in the reservoir and, under pressure conditions in the reservoir different from the certain pressure conditions, to permit fuel to enter the reservoir through the secondary fill opening in the event the primary opening is substantially blocked, wherein the reservoir structure is in combination with a suction tube in the reservoir, the suction tube being constructed and arranged to be coupled with a suction unit to draw fuel under certain conditions into the reservoir via the first fill opening and, when the first fill opening is substantially blocked, via the secondary fill opening; and in further combination with a fuel tank, the reservoir resting on a bottom surface of the fuel tank;

wherein the secondary fill opening and a bottom opening of the suction tube are generally at the same height with respect to the bottom surface of the fuel tank.

2. The reservoir structure of claim 1, wherein each of the first and second valve members is of generally umbrella shape and comprised of elastomer material.

3. The reservoir structure of claim 1, wherein the secondary opening is associated with a pocket in the bottom of the reservoir.

4. The reservoir structure of claim 3, wherein the pocket is defined by a step in the bottom of the reservoir.

5. A reservoir structure of a fuel delivery structure for a diesel vehicle, the reservoir structure including:

a fuel reservoir having a bottom surface, first means for permitting fuel to pass from a fuel tank of the vehicle into the reservoir, second means in the reservoir, communicating the fuel tank with the reservoir, for permitting fuel to pass from the fuel tank directly into the reservoir that is elevated from the bottom surface, means for closing the first means under certain pressure conditions in the reservoir and, under pressure conditions in the reservoir different from the certain pressure conditions, for permitting fuel to enter the reservoir through the first means, and means for closing the second means under certain pressure conditions in the reservoir and, under pressure conditions in the reservoir different from the certain pressure conditions, for permitting fuel to enter the reservoir through the second means in the event the first means is substantially blocked, wherein the reservoir structure is in combination with a suction tube in the reservoir, the suction tube being constructed and arranged to be coupled with a suction unit to draw fuel under certain conditions into the reservoir via the first means and, when the first means is substantially blocked, via the secondary means; and in further combination with a fuel tank, the reservoir resting on a bottom surface of the fuel tank;

wherein the second means is an opening in the reservoir and wherein the opening and a bottom opening of the suction tube are generally at the same height with respect to the bottom surface of the fuel tank.

6. The reservoir structure of claim 5, wherein each of the means for closing is a valve member of generally umbrella shape comprised of elastomer material.

7. The reservoir structure of claim 5, wherein the second means is an opening in the reservoir that is associated with a pocket in the bottom of the reservoir.

8. The reservoir structure of claim 7, wherein the pocket is defined by a step in the bottom of the reservoir.

* * * * *